US005704150A

United States Patent [19]

Milliman

[11] Patent Number: 5,704,150

[45] Date of Patent: *Jan. 6, 1998

[54] GUN WITH PIVOTING BARREL, ROTARY AMMUNITION CYLINDER, AND DOUBLE ACTION FIRING MECHANISM

[75] Inventor: Keith L. Milliman, Fairport, N.Y.

[73] Assignee: Crosman Corporation, East Bloomfield, N.Y.

[ * ] Notice: The term of this patent shall not extend beyond the expiration date of Pat. No. 5,160,795.

[21] Appl. No.: 308,358

[22] Filed: Sep. 19, 1994

Related U.S. Application Data

[62] Division of Ser. No. 901,774, Jun. 22, 1992, Pat. No. 5,400,536, which is a division of Ser. No. 737,209, Jul. 29, 1991, Pat. No. 5,160,795.

[51] Int. Cl.[6] ..... F41C 3/16

[52] U.S. Cl. ..... 42/67; 42/63

[58] Field of Search ..... 42/65, 67, 63; 89/155, 156, 33.03

[56] References Cited

U.S. PATENT DOCUMENTS

| | | | |
|---|---|---|---|
| 211,743 | 1/1879 | Joslyn | 42/63 |
| 373,898 | 11/1887 | Howe | 42/66 |
| 422,930 | 3/1890 | Fox | 42/66 |
| 1,049,105 | 12/1912 | Key | 42/59 |
| 2,150,914 | 3/1939 | Gaidos | 42/77 |
| 2,723,656 | 11/1955 | Andina | 124/40 |
| 2,980,096 | 4/1961 | Merz | 124/48 |
| 3,212,489 | 10/1965 | Merz | 124/48 |
| 3,612,026 | 10/1971 | Vadas | 124/31 |
| 3,726,266 | 4/1973 | Palmer | 42/59 |
| 3,741,189 | 6/1973 | Kester | 124/48 |
| 4,143,636 | 3/1979 | Liepins | 124/40 |
| 4,336,787 | 6/1982 | Cagnoni | 124/76 |
| 4,422,433 | 12/1983 | Milliman | 124/74 |
| 4,555,861 | 12/1985 | Khoury | 42/70.08 |
| 4,589,327 | 5/1986 | Smith | 89/148 |
| 4,651,456 | 3/1987 | Ghisoni | 42/65 |
| 4,774,929 | 10/1988 | Milliman | 42/44 |
| 4,841,840 | 6/1989 | Agner | 42/70.08 |
| 5,160,795 | 11/1992 | Milliman | 42/65 |

FOREIGN PATENT DOCUMENTS

| | | | |
|---|---|---|---|
| 10145 | 5/1898 | United Kingdom | 42/65 |

*Primary Examiner*—Stephen M. Johnson

[57] ABSTRACT

A gun includes a pivoting barrel assembly, a trigger/hammer double action firing mechanism, and a barrel/inline valve mechanism for firing projectiles. The pivoting barrel assembly includes a projectile-holding rotatable cylinder and an indexing mechanism for rotating the cylinder when the trigger is pulled. A hammer is cocked by a hammer link which is operatively connected to the trigger, and a cam on the hammer lifts the hammer link out of engagement with the hammer when the hammer reaches its cocked position. The valve mechanism includes a valve stem which is slidably mounted in a valve body. A pin portion on the valve stem extends through a valve seal and a valve seal retainer, and the valve seal retainer is retained in the valve body by retainer pins which extend through the body into a groove in the valve seal retainer. A detent housing is connected to the valve body, and a detent is slidably mounted with the detent housing. The detent is engageable with projectile chambers in the cylinder.

5 Claims, 7 Drawing Sheets

FIG. 5
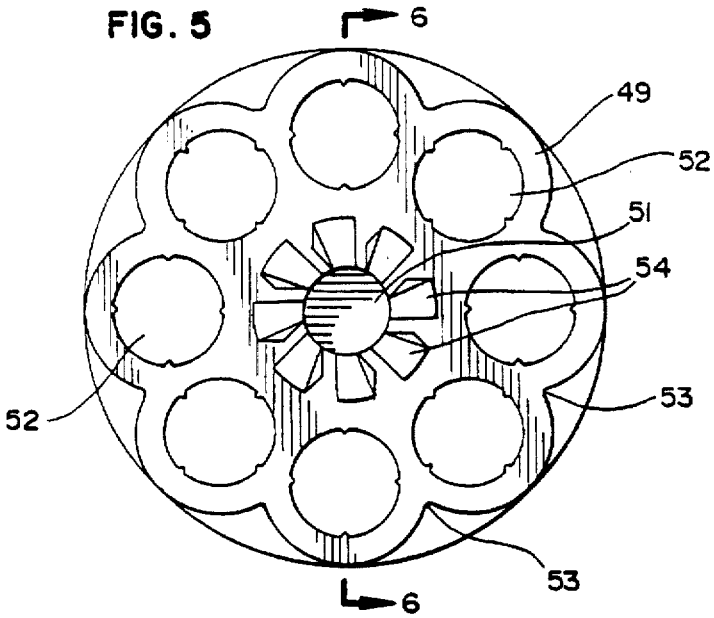
FIG. 6
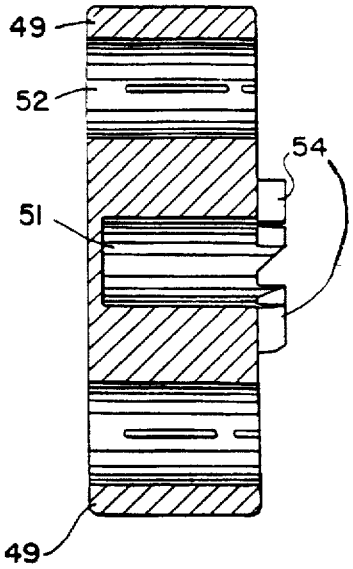
FIG. 7
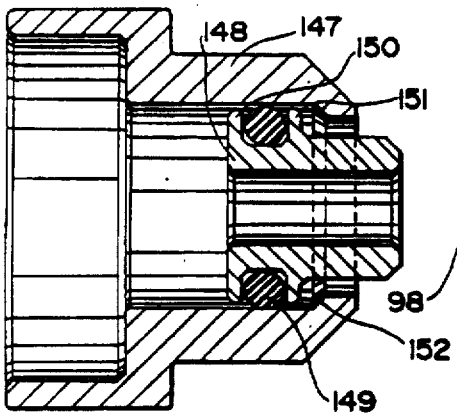
FIG. 9
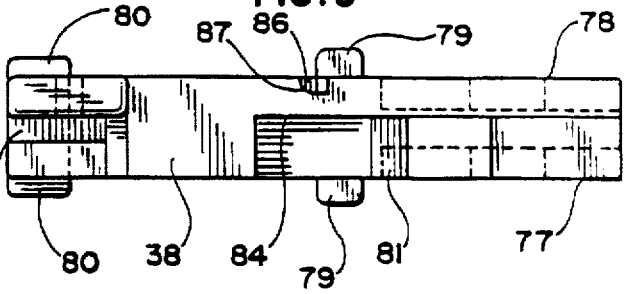
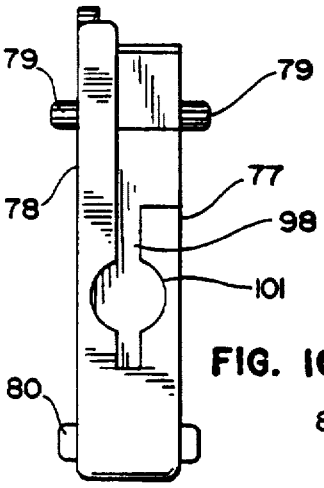
FIG. 10
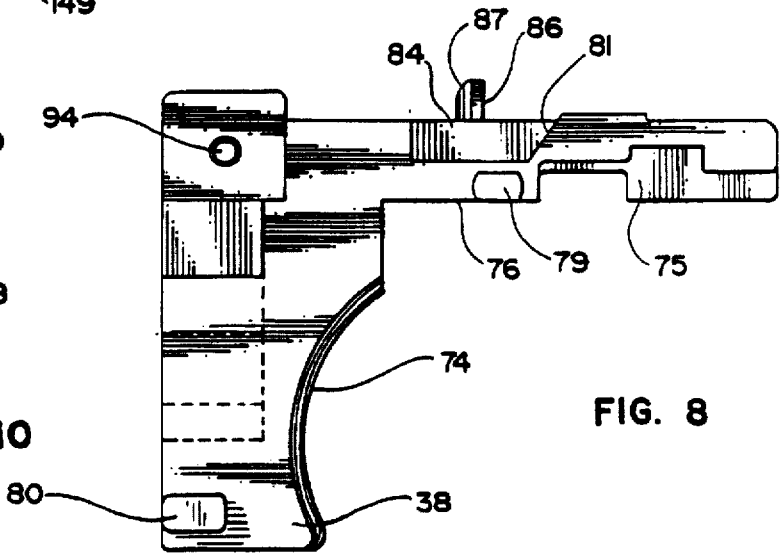
FIG. 8

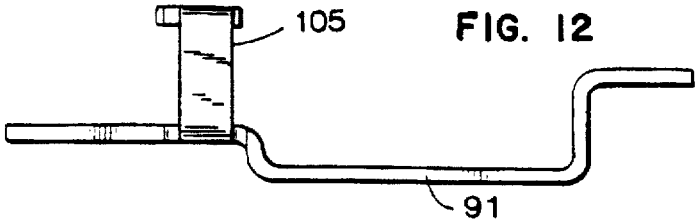
FIG. 12
FIG. 13
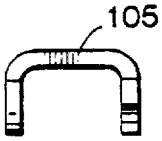
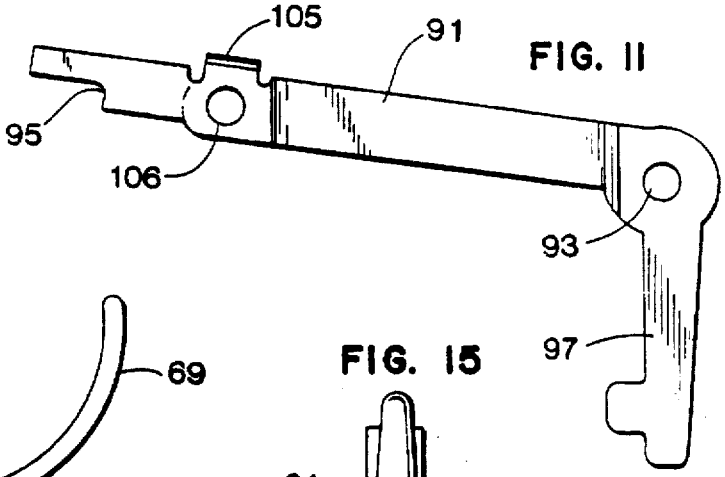
FIG. 11
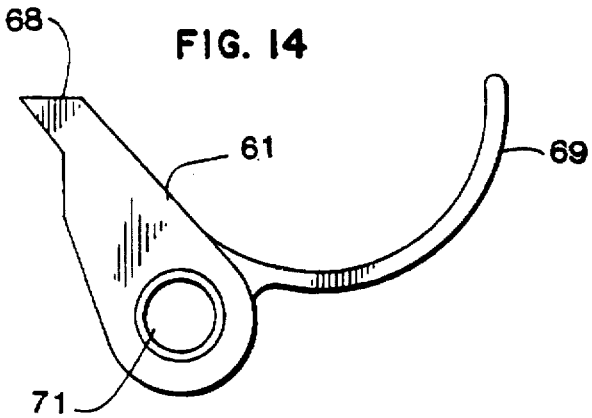
FIG. 14
FIG. 15
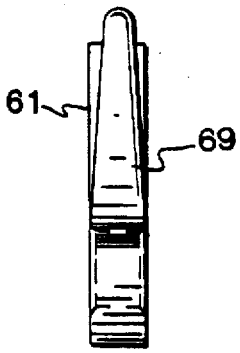
FIG. 17
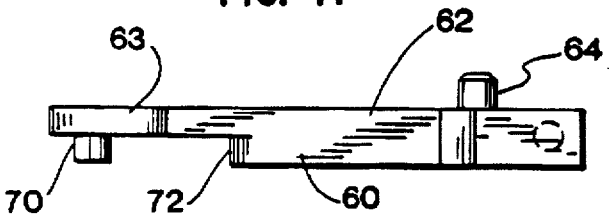
FIG. 18
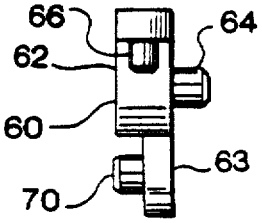
FIG. 16
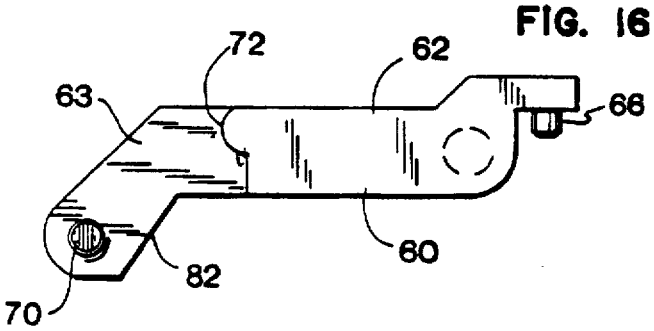

GUN WITH PIVOTING BARREL, ROTARY AMMUNITION CYLINDER, AND DOUBLE ACTION FIRING MECHANISM

RELATED APPLICATION

This application is a division of my application Ser. No. 07/901,774, filed Jun. 22, 1992, now U.S. Pat. No. 5,400,536 which is a division of application Ser. No. 07/737,209, filed Jul. 29, 1991, now U.S. Pat. No. 5,160,795.

BACKGROUND

This invention relates to guns, and more particularly, to a gun which is equipped with a pivoting barrel assembly, a rotary ammunition cylinder, an indexing mechanism for rotating the cylinder, a double acting firing mechanism, and inline valve assembly.

Guns have been provided with pivoting barrels in the past. For example, U.S. Pat. No. 4,774,929 describes an air gun which includes a pivoting barrel. A pivoting barrel permits checking the bore for ammunition and easy cleaning of the bore. Other patents describe a rotary ammunition cylinder which is mounted on a pivoting barrel, for example, U.S. Pat. Nos. 4,422,433, 3,212,489, and 2,980,096. The cylinder is generally rotated by an indexing mechanism on the gun frame which is operated by the trigger.

Guns have also been provided with trigger/hammer double action firing mechanisms which utilize a trigger link for cocking the hammer when the trigger is pulled. Guns which are operated by compressed gas and ammunition cylinder and/or a pivoting barrel may also include a barrel inline valve mechanism for releasing a charge of compressed gas to fire a projectile through the barrel.

SUMMARY OF THE INVENTION

The invention provides a gun which includes features which are improvements over the foregoing prior art guns. An indexing mechanism for a rotary ammunition cylinder is mounted on the pivoting barrel assembly, thereby permitting functional testing of the indexing mechanism independently of the gun frame. The indexing mechanism includes a pawl which is engageable by a cam surface on the trigger which not only actuates the pawl to rotate the cylinder but maintains the pawl in alignment with the cylinder. A trigger link is connected to the trigger for cocking the hammer as the trigger is pulled. An integral cam on the hammer disengages the trigger link when the hammer is fully cocked. The cam also prevents the trigger link from moving out of its operative position if the hammer is cocked without pulling the trigger. A safety link is rotatably mounted on the trigger link and is engageable by the hammer for firing a valve assembly. The valve assembly includes a valve stem which is slidably mounted in a valve body. The valve stem extends through a valve seal and valve seal retainer, and the valve seal retainer is retained in the valve body by pins which extend through the valve body into a groove in the valve seal retainer. The retainer pins eliminate the need for threading the valve body and eliminate the possibiity of rotational movement between the valve stem and the valve seal which might mar the seal. An alignment pin on the trigger is engageable with the cylinder to ensure alignment between the cylinder and the barrel during firing.

DESCRIPTION OF THE DRAWING

The invention will be explained in conjunction with an illustrative embodiment shown in the accompanying drawing, in which—

FIG. 5 is a sectional view of the rotary ammunition cylinder;

FIG. 6 is a front elevational view of the ammunition cylinder;

FIG. 7 is a sectional view of the barrel detent assembly;

FIG. 8 is a side elevational view of the trigger;

FIG. 9 is a plan view of the trigger;

FIG. 10 is a rear elevational view of the trigger;

FIG. 11 is a side elevational view of the trigger link;

FIG. 12 is a top plan view of the trigger link;

FIG. 13 is a rear elevational view of the trigger link;

FIG. 14 is a side elevational view of the indexing pawl;

FIG. 15 is a front elevational view of the indexing pawl;

FIG. 16 is a side elevational view of the indexing lever;

FIG. 17 is a top plan view of the indexing lever;

FIG. 18 is a front elevational view of the indexing lever;

DESCRIPTION OF SPECIFIC EMBODIMENT

Figures 1, 25, 26:
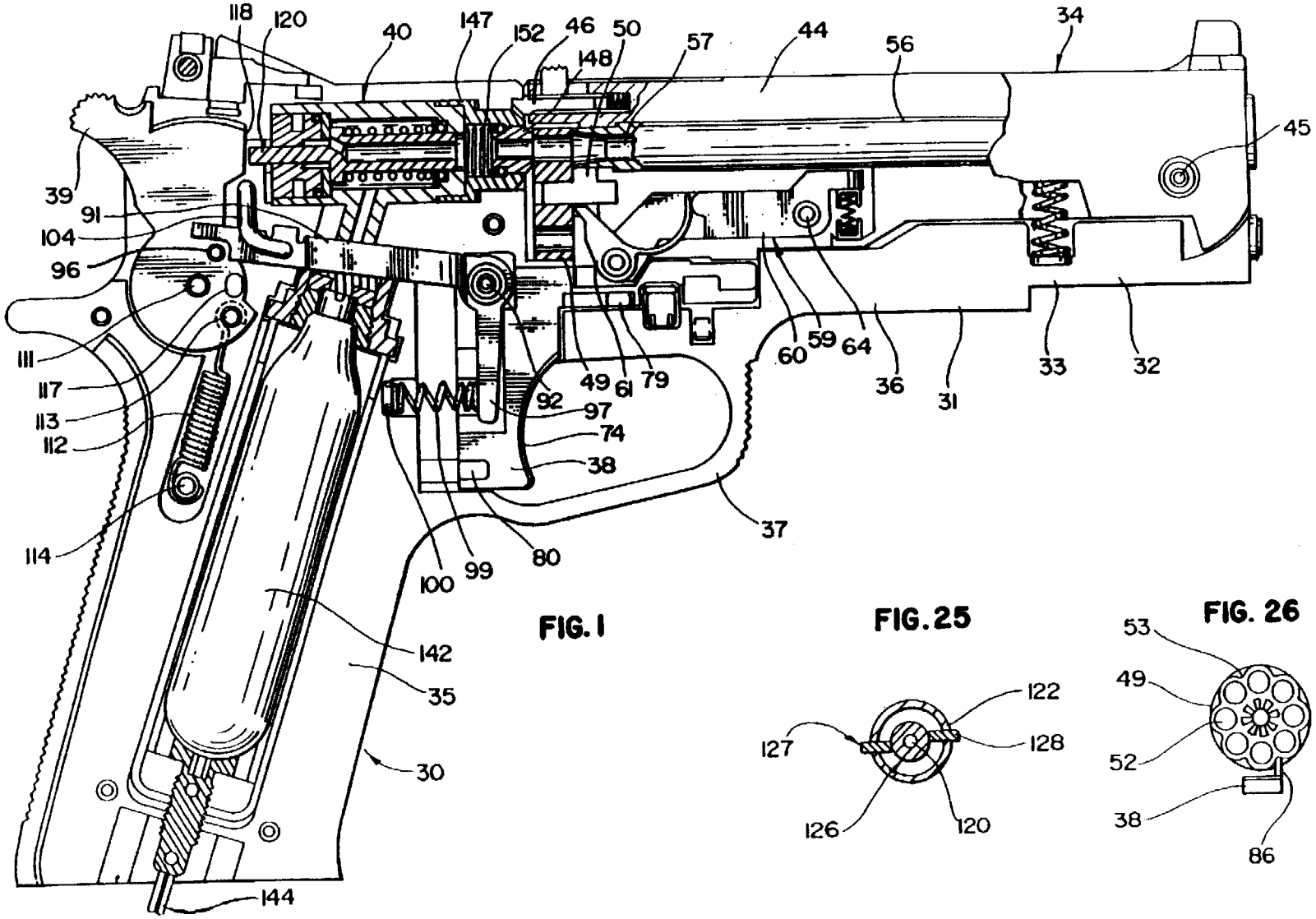
FIG. 1 is a side elevational view, partially broken away, of a gun formed in accordance with the invention.
FIG. 25 is a sectional view taken along the line 25—25 of FIG. 24.
FIG. 26 is a fragmentary sectional view taken along the line 26—26 of FIG. 4.

Referring to FIGS. 1–4, the invention will be described with respect to a pistol 30, although the invention can also be used in a rifle. The pistol includes a frame 31 which is provided by right and left frame halves 32 and 33 and a barrel assembly 34. The frame includes a grip portion 35, barrel portion 36, and a trigger housing 37.

A trigger 38 is slidably mounted in the frame and is operatively connected to a hammer 39 which is pivotably mounted in the frame. As will be explained more fully hereinafter, the trigger is movable between a rest position illustrated in FIG. 1 and a firing position illustrated in FIG. 4. Pulling the trigger first cocks the hammer (FIG. 3) and then releases the hammer to actuate a valve assembly 40. The valve assembly releases a charge of compressed gas to fire a projectile.

Pivoting Barrel Assembly

The barrel assembly 34 includes an elongated shroud or housing 44 which is pivotably connected to the frame 31 by a pin 45. The barrel assembly is maintained in the closed or firing position illustrated in FIG. 1 by a latch 46 which is slidably mounted in the barrel housing and which extends into a recess in the frame. A spring 47 pivots the barrel assembly clockwise to the open or loading position illustrated in FIG. 2 when the latch is moved forwardly.

A rotary ammunition cylinder 49 is rotatably mounted in the barrel housing by a pin 50. Referring to FIGS. 5 and 6, the cylinder is provided with a central recess 51 for the pivot pin 50 and a plurality of bores 52 for retaining ammunition such as pellets. The forward portion of the cylinder is provided with coring or grooves 53 between adjacent bores 52. The front end of the cylinder is provided with a plurality of conventional indexing ratchet teeth 54 for rotating the cylinder.

An elongated barrel 56 is mounted in the barrel housing. The barrel has an internal bore 57, and the rear end of the bore is flared outwardly to facilitate receiving a projectile when the gun is fired. The rotational axis of the ammunition cylinder is parallel to the axis of the barrel.

An indexing assembly 59 on the barrel housing includes an index lever 60 and an index pawl 61. Referring to FIGS. 16–18, the index lever includes a longitudinally extending forward portion 62 and a downwardly angled rear portion 63. The lever is pivotably mounted on the barrel housing by a pin 64 which extends laterally from the forward portion 62 into a recess in the barrel housing, and the lever is resiliently biased to rotate clockwise by an index spring 65 (FIG. 2) which fits over a retainer pin 66 on the lever.

The pawl 61 (FIGS. 14 and 15) includes a ratchet-engaging point 68 and a curved spring portion 69 which is formed integrally with the remainder of the pawl. The pawl is advantageously molded from plastic such as Black Delrin II 100, and the curved spring portion is flexible and resilient.

The pawl 61 is pivotably mounted on the lever 60 by a pin 70 (FIGS. 16–18) on the rear end of the lever which extends into an opening 71 in the pawl. The spring 69 engages a shoulder 72 on the lever for resiliently biasing the pawl to rotate in the counterclockwise direction. The lever is advantageously molded from plastic such as Black Zytel 70633.

The interaction between the point 68 of the pawl and the ratchets 54 on the cylinder 49 is conventional and need not be explained in detail. As the pawl moves upwardly in FIG. 1, it engages one of the ratchets and rotates the cylinder to move one of the ammunition bores 52 into alignment with the barrel 56. As the pawl returns downwardly, it slides over the next ratchet by rotating clockwise against the force of the spring 69.

Since the ammunition cylinder 49 and the indexing assembly 59 are mounted on the barrel assembly independently of the frame 31, the indexing mechanism can be tested independently of the frame before the barrel assembly is mounted on the frame. Independent testing of the indexing mechanism improves economy and reliability of the product.

Trigger/Hammer Firing Mechanism

Referring to FIGS. 8–10, the trigger 38 includes a curved finger portion 74 and a mounting portion 75. The mounting portion 75 includes a flat bottom surface 76 and flat side surfaces 77 and 78 which engages flat surfaces on the frame 31 for maintaining the alignment of the trigger as the trigger moves between its rest and firing positions. A pair of upper lateral projections 79 on the mounting portion of the trigger and a pair of lower lateral projections 80 on the finger portion are slidably received in longitudinal recesses in the frame for guiding the movement of the trigger.

The right side of the mounting portion 75 of the trigger includes a camming ramp 81 which extends at an angle of about 55 degrees from the horizontal. The camming ramp 81 is engageable with an angled flat camming surface 82 (FIG. 16) on the index lever 60 which also extends at an angle of about 55 degrees from the flat top and bottom surfaces of the lever. As the trigger is pulled from its rest position in FIG. 1, the cam 81 forces the index lever 60 and the index pawl to rotate clockwise about the pivot pin 64 and rotates the cylinder 49.

The angled rear portion of the index lever is confined between the flat surface 84 on the trigger and the frame 31. The flat surfaces 76–78 of the trigger and the mating flat surfaces of the frame 31 and the flat surface 84 extend parallel to the axis of the barrel and the axis of rotation of the ammunition cylinder. The index lever and index pawl are thereby maintained to rotate in planes which extend parallel to the axis of the barrel and the axis of rotation of the cylinder through the firing sequence. The need for secondary detenting of the index assembly is thereby eliminated.

Figure 4:
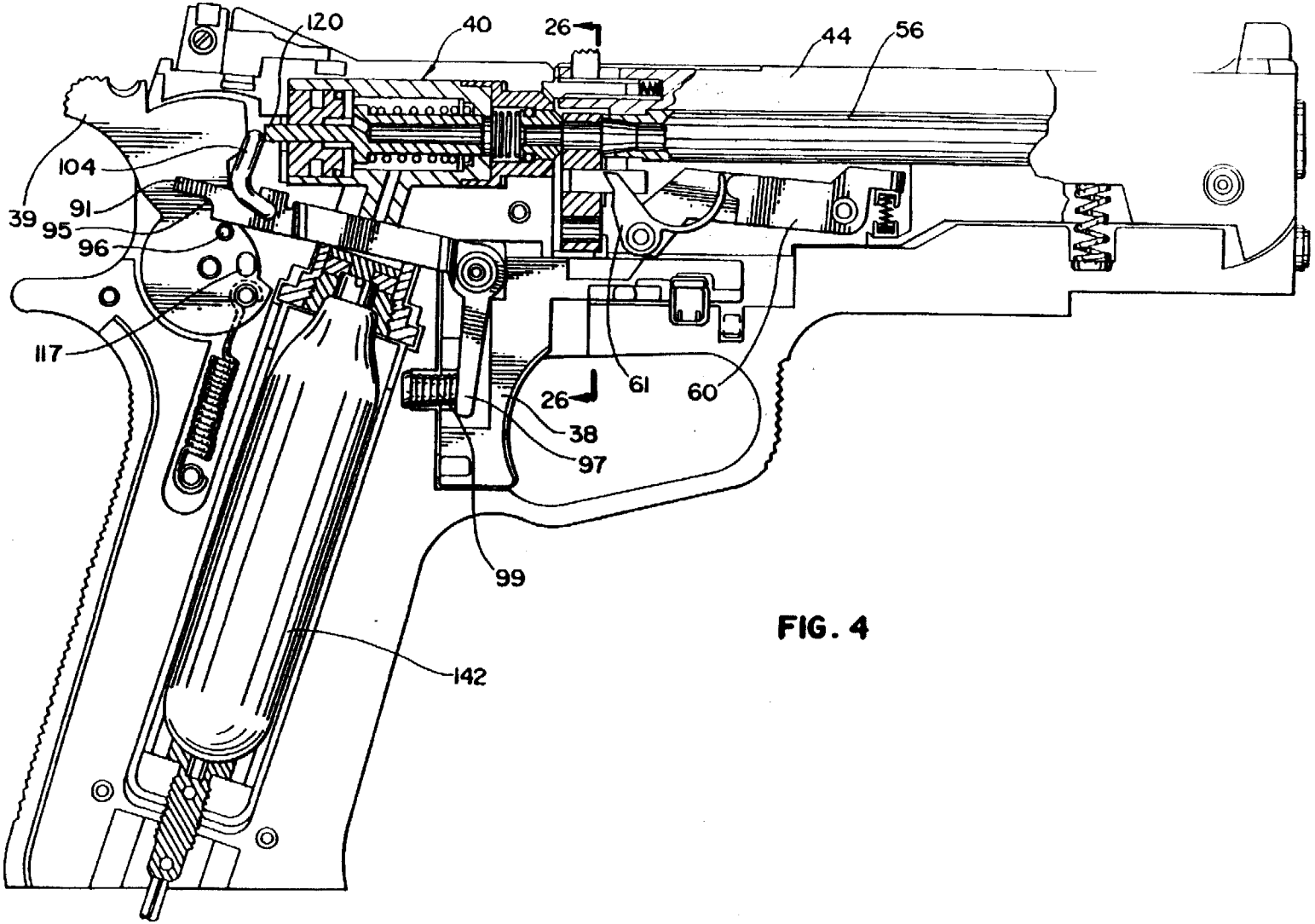
FIG. 4 is a view similar to FIG. 3 showing the trigger pulled to release the hammer and fire the gun.

As the trigger approaches the firing position of FIG. 4, an alignment pin 86 (FIGS. 8 and 26) enters one of the grooves 53 on the outside of the cylinder. If an ammunition bore 52 is not precisely aligned with the barrel 56, the alignment pin will cam the cylinder into precise alignment. The alignment pin includes curved camming surfaces 87 (FIGS. 8, 9, and 26) on the top and sides thereof for engaging and camming the cylinder as the pin enters the center of the groove 53. The alignment pin is positioned in front of the cylinder during indexing of the cylinder by the pawl.

A trigger link 91 (FIGS. 1, 11–13) is pivotably connected to the rear of the trigger by a pin 92 (FIG. 1) which extends through an opening 93 in the trigger link and an opening 94 (FIG. 8) in the trigger. The rear end of the trigger link is provided with a notch 95 which is engageable with a roller 96 (FIG. 1) on the hammer 39 for cocking the hammer as the trigger is pulled. The trigger link includes a lever portion 97 which extends within a recess 98 (FIG. 9 and 10) in the rear of the trigger. A trigger spring 99 (FIG. 1) extends from a recess 100 in the frame 31 into a recess 101 (FIG. 10) in the trigger. The spring 99 resiliently biases the trigger link to rotate counterclockwise and resiliently biases the trigger toward its rest position of FIG. 1. The need for separate springs for the trigger and the trigger link is therefore eliminated.

Figure 19:
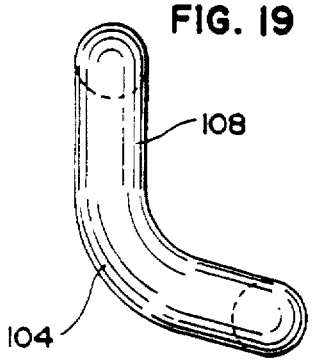
FIG. 19 is a side elevational view of the safety link.
Figure 20:
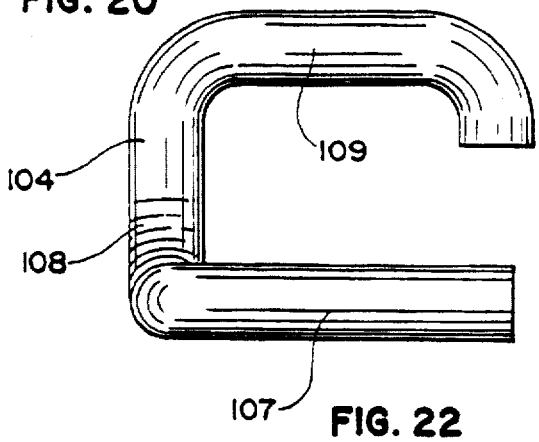
FIG. 20 is a front elevational view of the safety link.

A safety link 104 is rotatably mounted on the trigger link adjacent the notch 95. Referring to FIGS. 12 and 13, the trigger link includes a U-shaped saddle portion 105 which is provided with openings 106. Referring to FIGS. 19 and 20, the safety link 104 includes a pivot pin portion 107 which extends through the openings 106, an intermediate portion 108, and an impact portion 109 which extends parallel to the pivot pin 107.

Figure 21:
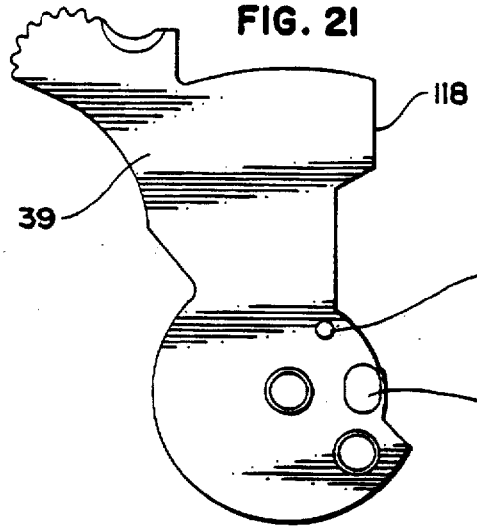
FIG. 21 is a side elevational view of the hammer.
Figure 22:
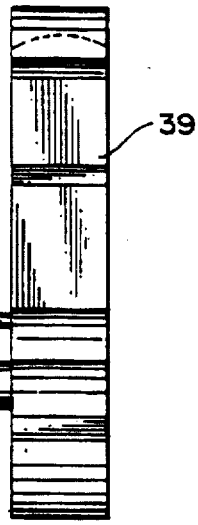
FIG. 22 is a front elevational view of the hammer.
Figure 23:
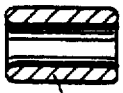
FIG. 23 is a sectional view of the pin roller for the hammer.

The hammer 39 is pivotably mounted on the frame 31 by a hammer pin 111 and is resiliently biased to rotate clockwise by a hammer spring 112 which is connected to a pin 113 on the hammer and a pin 114 on the frame 31. Referring to FIGS. 21 and 22, a pin 115 is mounted on the hammer and rotatably supports a cylindrical roller 96 (FIG. 23). A cam 117 projects laterally from one side of the trigger and is advantageously formed integrally with the trigger. The hammer and cam can be formed integrally from sintered iron or metal alloy. The hammer includes a impact portion 118 for actuating the valve assembly 40.

As the trigger is pulled rearwardly, the notch 95 on the trigger link 81 engages the roller 96 on the hammer, which provides a detent or abutment between the hammer and the trigger link. The hammer is thereby rotated counterclockwise to the cocked position illustrated in FIG. 3. As the trigger is pulled farther, the cam 117 engages the trigger link and lifts the notch 96 out of engagement with the roller 96, permitting the hammer to rotate to the fired position of FIG. 4. As the trigger link is moved rearwardly by the trigger, the safety link 104 is moved into a position between the impact portion 118 of the hammer and a valve stem 120 in the valve assembly 40 so that the valve stem will be forced forwardly by the hammer. If the hammer is cocked and released without pulling the trigger, the safety link will not be positioned between the hammer and the valve stem, and the gun will not fire. Rotatably mounting the safety link on the trigger link rather than on the trigger eliminates the need for a trigger extension to keep the intermediate portion 108 of the safety link perpendicular to the valve stem 120. The perpendicular position allows transfer of maximum energy from the hammer to the valve stem.

The cam 117 on the hammer prevents the trigger link from falling downwardly if the hammer is cocked without pulling the trigger. The trigger link will be supported by the cam so that the trigger link can engage the roller 96 when the hammer returns to the fired position. If the trigger link were permitted to fall downwardly so that it could no longer engage the roller, the gun would be inoperative.

Valve Assembly

Figure 24:
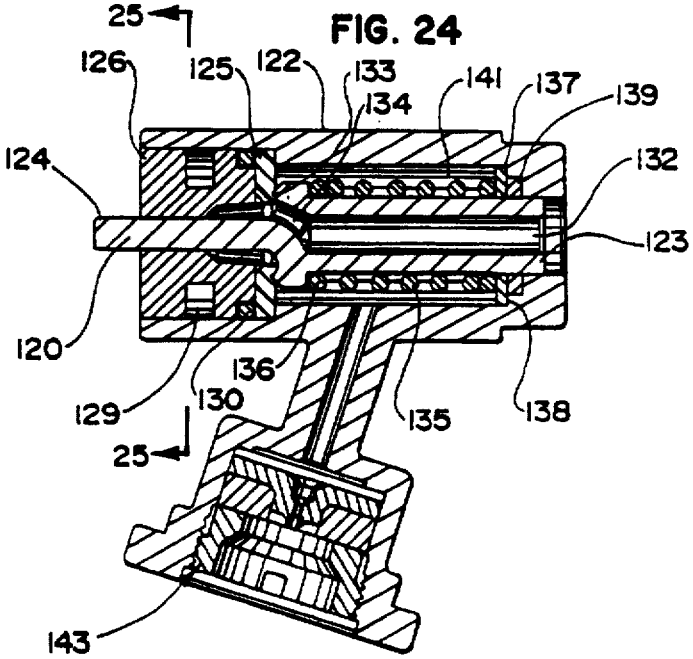
FIG. 24 is a sectional view of the valve assembly.

Referring to FIGS. 24 and 25, the valve assembly 40 includes a valve body 122 in which the valve stem 120 is slidably mounted. The valve stem 120 includes a cylindrical forward portion 123 and a rear pin portion 124. The pin portion 124 extends through an annular valve seal 125 and a spool-shaped valve seal retainer 126. The valve seal retainer is inserted linearly or axially into the valve body and is retained by a pair of retainer pins 127 and 128 which extend through the wall of the valve body into an annular groove 129 in the valve seal retainer. The pins 127 and 128 are offset from a diameter through the valve body, one pin above the diameter and one pin below the diameter, to prevent the valve seal retainer from rocking within the valve body. The forward end of the valve seal retainer is provided with an annular recess for receiving an O-ring 130 which provides a gas-tight seal between the valve seal retainer and the valve body. The valve seal retainer is preferably formed from brass, and the valve seal 125 is preferably formed from Hytrel.

The valve stem 120 includes a central bore 132, an annular valve seal 133, and three orifices 134 which provide communication between the bore 132 and the exterior of the valve stem. The valve seat 133 is resiliently biased against the valve seal 125 to seal the orifice 134 by a spring 135. The rear end of the spring engages a shoulder 136 on the valve stem, and the front end of the spring engages an annular washer 137. The washer engages a shoulder 138 on the valve body, and an O-ring 139 provides a gas-tight seal between the forward end of the valve stem and the valve body.

The annular space 141 between the valve stem and the valve body provides a reservoir for compressed gas. In the particular gun illustrated, the compressed gas is supplied by a conventional $CO_2$ cartridge 142 (FIG. 1) which is positioned in a recess in the grip 35. However, the compressed gas can also be air which is provided by a conventional air pump. The $CO_2$ cartridge is forced into a conventional piercing assembly 143 in the bottom of the grip by a conventional bracket assembly 144 (FIG. 1).

Figure 2:
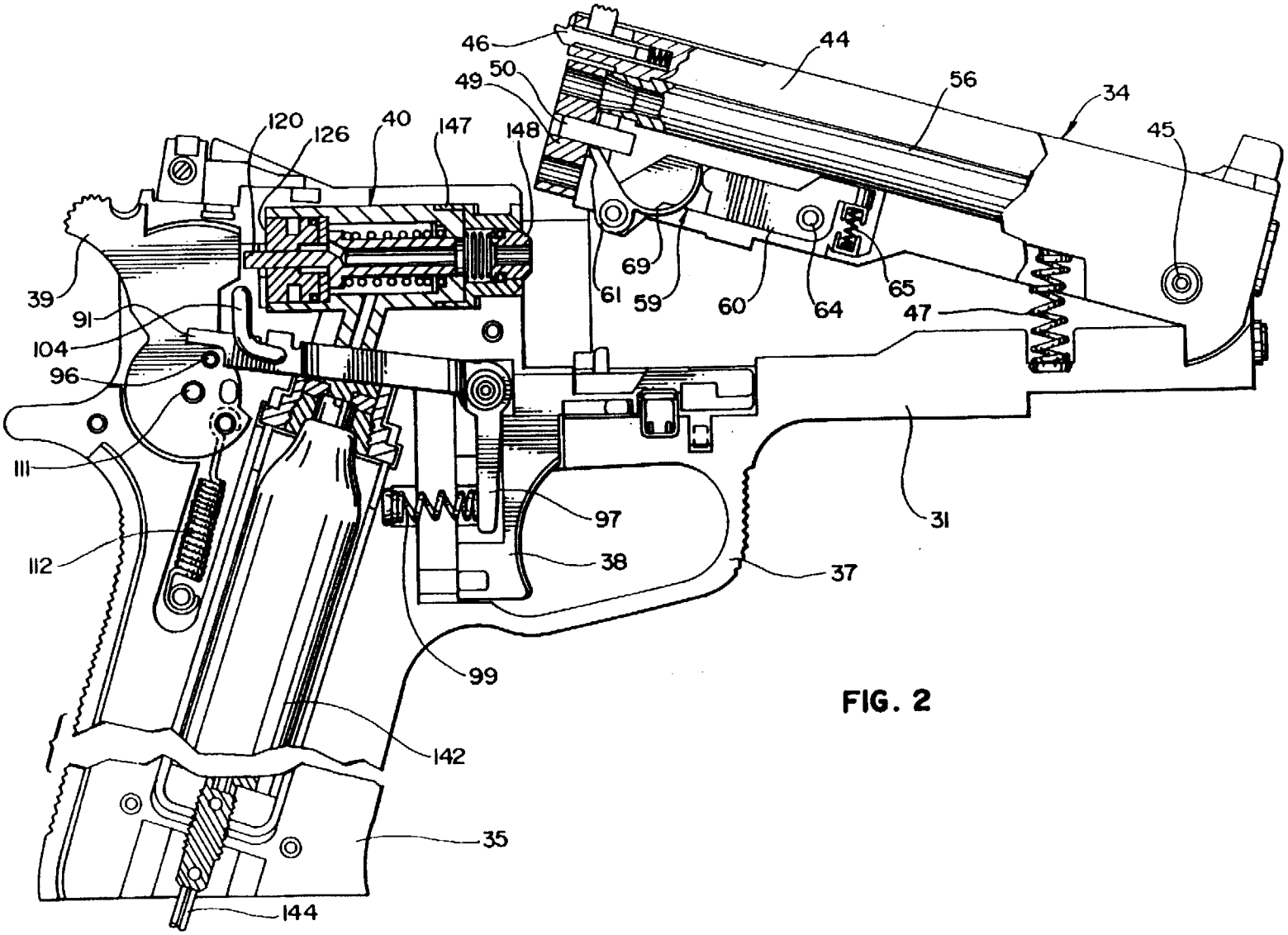
FIG. 2 is a view similar to FIG. 1 showing the barrel assembly in an open position.
Figure 3:
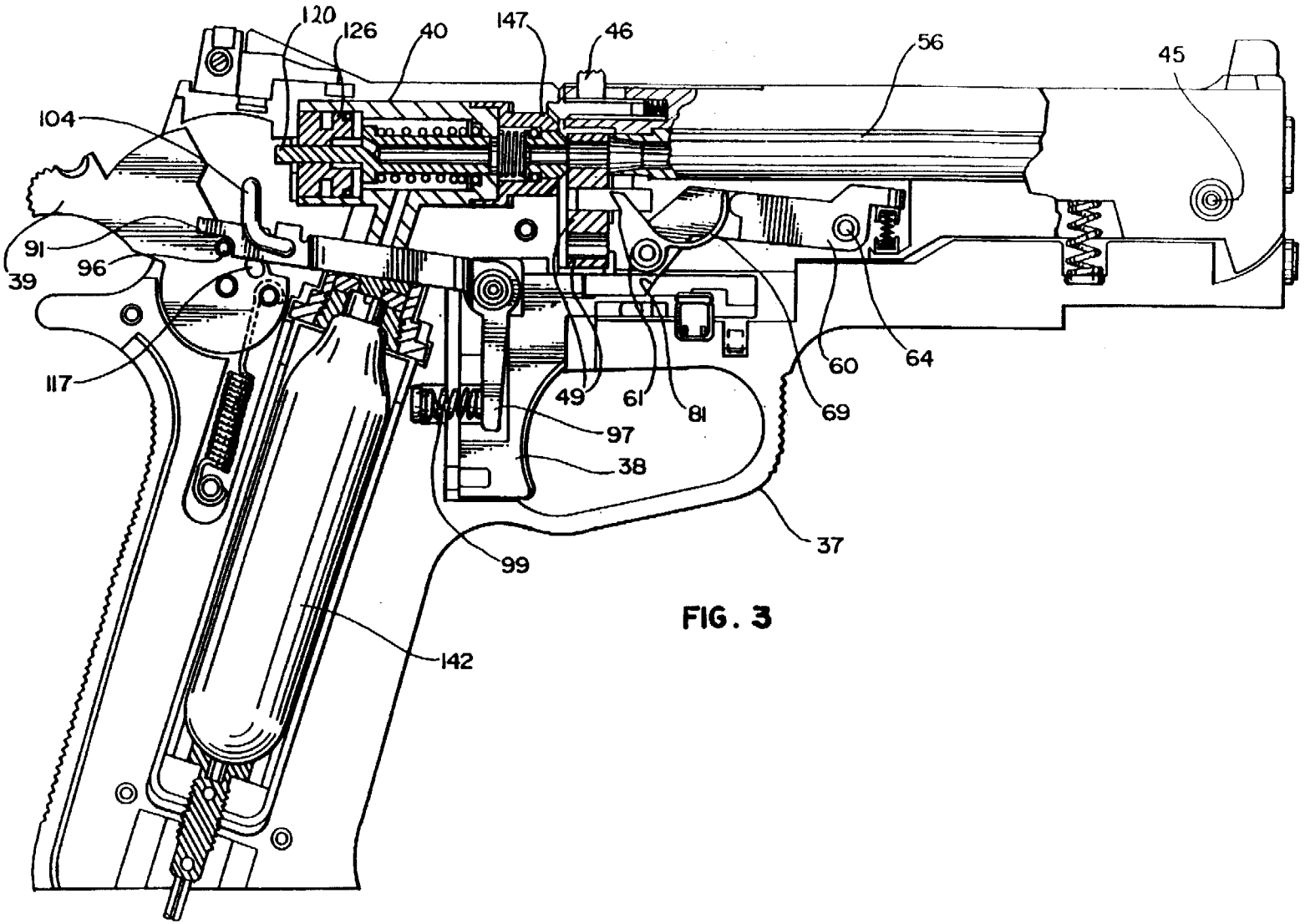
FIG. 3 is a view similar to FIG. 1 showing the trigger partially pulled to cock the hammer.

A detent housing 147 (FIGS. 1 and 7) is ensleeved over the forward end of the valve body, and a cylindrical detent 148 is slidably mounted within the detent housing. An O-ring 149 is retained between a pair of annular ribs 150 and 151 to provide a gas-tight seal between the detent and the detent housing. A spring 152 (FIG. 1) resiliently biases the detent toward the barrel 56. An inwardly extending lip on the front end of the detent housing retains the detent in the housing when the barrel assembly is open (FIG. 2).

The valve assembly 40 provides means for firing a projectile from the ammunition cylinder 49 through the barrel 56. When the hammer strikes the pin portion 124 of valve stem 120, the valve stem is forced forwardly so that the valve seat 133 moves out of engagement with the valve seal 125. A charge of compressed gas in the reservoir 141 is released through the orifices 134 and central bore 132 of the valve stem and forces a projectile in the ammunition bore 52 which is aligned with the barrel out of the barrel. The spring 135 returns the valve stem to its sealing position after the impact energy of the hammer dissipates.

The annular groove 129 in the valve seal retainer 126 and the retention pins 127 and 128 permit the valve seal retainer to be inserted linearly into the valve body and eliminates the need for threading the valve body and the valve seal retainer. The omission of the threading steps eliminates the possibility of chips from a threading operation, which could contaminate the components of the valve assembly and cause leakage.

The pins 127 and 128 are offset from a diameter through the valve body to prevent the valve retainer from rocking within the valve body. If the pins were located on a diameter, they could act as pivot pins for the valve seal retainer and allow the valve seal retainer to rock within the valve body to the extent of clearance between the valve seal retainer and the valve body when the gun fires. Since the force from the safety link 104 is rotational, the safety link could cause uneven side-to-side loading on the valve seal retainer due to friction. By staggering the pins from side-to-side off of the diameter through the valve seal retainer, a shoulder is created which prevents the valve seal retainer from rocking during firing. The valve seal retainer is held firmly against the pins by the force from spring 135 and by the force created by the $CO_2$ pressure within the valve body.

The linear assembly of the valve assembly also eliminates relative rotation between the valve stem 120 and the valve seal 125 as the valve assembly is assembled. Relative rotation between those parts could mar or tear the valve seal and adversely affect the gas-tight seal. Relative rotation between the valve seal and the valve stem after assembly is prevented by friction between the valve seal and the valve seal retainer caused by the O-ring 130 which is compressed between the valve seal and valve seal retainer and by the friction force exerted on the valve stem by the compressed spring 135.

While in the foregoing specification a detailed description of the specific embodiment of the invention was set forth for the purpose of illustration, it will be understood that many of the details herein given may be varied considerably by those skilled in the art without departing from the spirit and scope of the invention.

I claim:

1. A gun comprising:

a frame, a barrel assembly pivotally attached to the frame, the barrel assembly including an elongated barrel having a longitudinal axis, a cylinder rotatably supported by the barrel assembly for rotation about an axis which extends parallel to the longitudinal axis of the barrel, the cylinder being provided with a plurality of means for retaining a projectile and ratchet means for rotating the cylinder, a trigger supported by the frame for movement between a rest position and a firing position, indexing means supported by the barrel assembly for rotating the cylinder to align one of the projectile-retaining means with the barrel, the indexing means including a lever pivotably supported by the barrel assembly, a pawl pivotably mounted on the lever and engageable with the ratchet means on the cylinder for rotating the cylinder as the lever pivots in one direction, and a cam slidably supported by the frame and engageable with the lever for pivoting the lever in said one direction, the cam being operatively connected to the trigger whereby movement of the trigger from the rest position toward the firing position causes sliding movement of the cam and pivots the lever in said one direction.

2. The gun of claim 1 in which the pawl includes a spring which is formed integrally with the remainder of the pawl and which is engageable with the lever for resiliently biasing the pawl against the ratchet means.

3. The gun of claim 1 in which the cam includes means for maintaining the pawl to rotate in a plane which extends parallel to the axis of rotation of the cylinder as the trigger moves from the rest position toward the firing position.

4. The gun of claim 3 in which said means for maintaining the pawl includes a flat surface which extends from the cam parallel to the axis of rotation of the cylinder and which engages the indexing means.

5. A gun comprising:

a frame, a barrel assembly supported by the frame, the barrel assembly including an elongated barrel having front and rear ends and a longitudinal axis, a cylinder rotatably supported by the barrel assembly for rotation about an axis which extends parallel to the longitudinal axis of the barrel, the cylinder having front and rear ends, a plurality of means for retaining a projectile, and ratchet means on the front end of the cylinder for rotating the cylinder, a trigger supported by the frame for movement between a forward rest position and a rearward firing position, indexing means supported by the barrel assembly forwardly of the cylinder for rotating the cylinder to align one of the projectile-retaining means with the barrel, the indexing means including a lever pivotably supported by the barrel assembly, a pawl pivotably mounted on the lever and engageable with the ratchet means on the cylinder for rotating the cylinder as the lever pivots in one direction, and a cam slidably supported by the frame and engageable with the lever for pivoting the lever in said one direction, the cam being operatively connected to the trigger whereby rearward movement of the trigger from the rest position toward the firing position causes sliding movement of the cam and pivots the lever in said one direction.

* * * * *